US006247386B1

(12) United States Patent
Gummow

(10) Patent No.: US 6,247,386 B1
(45) Date of Patent: Jun. 19, 2001

(54) DUAL ACTION INDEXABLE WRENCH

(76) Inventor: Stephen Gummow, 4858 Freeport Rd., Rockton, IL (US) 61072

( * ) Notice: Subject to any disclaimer, the term of this patent is extended or adjusted under 35 U.S.C. 154(b) by 0 days.

(21) Appl. No.: 09/413,629

(22) Filed: Oct. 6, 1999

(51) Int. Cl.[7] ..... B25B 23/16
(52) U.S. Cl. ..... 81/177.8
(58) Field of Search ..... 81/58.1, 60, 177.8, 81/177.9, 177.85

(56) References Cited

U.S. PATENT DOCUMENTS

| | | | | |
|---|---|---|---|---|
| 1,417,338 | | 5/1922 | Lenahan . | |
| 1,568,442 | * | 1/1926 | Carver | 81/177.8 |
| 1,764,379 | * | 6/1930 | Zilliox | 81/177.8 |
| 1,822,428 | * | 9/1931 | Zilliox | 81/177.8 |
| 4,334,445 | * | 6/1982 | Timewell | 81/177.8 |
| 4,406,186 | * | 9/1983 | Gummow | 81/177.8 |
| 4,688,454 | * | 8/1987 | Scull | 81/177.8 |
| 4,805,494 | | 2/1989 | Santoro . | |
| 5,419,221 | | 5/1995 | Cole . | |
| 5,694,818 | | 12/1997 | Nickipuc . | |
| 5,775,184 | * | 7/1998 | Cole | 81/177.8 |
| 5,941,141 | | 8/1999 | Whitley . | |

* cited by examiner

*Primary Examiner*—Joseph J. Hail, III
*Assistant Examiner*—Joni B. Danganan
(74) *Attorney, Agent, or Firm*—Wallenstein & Wagner, Ltd.

(57) ABSTRACT

An improved dual action indexable wrench having a moment arm connected to a wrench body which can be operated in a first configuration to apply force directly and in a second configuration to apply force by reciprocal motion, which can be readily switched between the two configurations by engaging and disengaging a shoulder on the wrench body having a v-shaped notch and a corresponding leading edge on the handle having square corners dimensioned to be received within the notch on the shoulder.

12 Claims, 3 Drawing Sheets

DUAL ACTION INDEXABLE WRENCH

BACKGROUND OF THE INVENTION

1. Field of the Invention

This invention relates to indexable wrenches to which other tools such socket heads, crowfoot-type wrenches and the likes are connected for use to install and tighten nuts, bolts and other threaded means, and to break loose the same.

More particularly, this invention relates to an improved indexable dual action wrench which can be used in a first variably angled configuration to transmit force applied to a moment arm. In a second configuration, the moment arm can be moved to reciprocate and rapidly rotate the attachment mechanism relative to the moment arm.

2. Discussion of the Prior Art

Indexable dual action wrenches like the one set forth in U.S. Pat. No. 4,406,186 to the present inventor, Stephen A. Gummow, apply direct torque to a socket head in a first configuration to tighten or loosen a nut and in a second configuration, to rapidly rotate the socket head to spin the nut. That wrench provides more than one position for the handle relative to the wrench body.

In U.S. Pat. No. 5,419,221 to James E. Cole, another indexable head ratchet wrench is disclosed. That device describes a dual action wrench which, in its locked position, utilizes a half-splined connecting pin to engage complimentary splines on the inner surface of an orifice in the wrench body as a means to prevent rotation about the axis of the pin. One of the major drawbacks of this deslon is the susceptibility of the splines on the inner surface of the orifice to chipping., burring and breaking. Additionally, in order to permit the handle to move between the locked and unlocked positions, it is necessary for the orifice in the handle to be substantially larger that the "unsplined" portion of the pin which it engages in the unlocked position, resulting with sloppiness in the movement of the handle when in the unlocked position. It is therefore an object of the present invention to provide an improved dual action wrench which operates in a locked configuration and an unlocked configuration, in which the device can be readily switched between the two configurations.

It is a further object of the present invention to provide an improved dual action wrench which is switchable between the locked and unlocked configurations, which may be readily positioned in a limited number of different angles in the locked configuration, the positions corresponding to 45° increments.

A still further object of the present invention is to provide an improved dual action wrench which is movable between a locked or direct torque configuration and an unlocked or reciprocal configuration, in which the difficulties and drawbacks of prior devices are avoided, including those associated with reliance on mating splines to lock and unlock the wrench.

Other objects and advantages of the inventions will appear hereinafter.

SUMMARY OF THE INVENTION

A ratchet wrench including a preferred embodiment of the invention comprises a ratchet head, a connecting pin, and a handle. The ratchet head includes a conventional ratchet system for rotating a shank about an axis. A conventional socket or an open-end or closed-end crowfoot-type wrench can be connected to a shank.

The generally cylindrical connecting pin aligned along an axis parallel to the shank axis and attached to the ratchet head. The connecting pin extends through an orifice in the handle, thereby connecting the handle to the ratchet head. A shoulder of the ratchet head includes a v-shaped notch that is adapted to receive the corner of the handle in a complementary manner to prevent rotation of the handle about the connecting pin axis: and an indented portion of the connecting pin is adapted to allow the handle to rotate freely about the connecting pin axis.

The handle is slidable between a locked position and a unlocked position on the connecting pin. In the locked position the handle orifice is disposed about the connecting pin. The handle corner engages the v-shaped notch and the ratchet wrench can be used to rotate a nut or bolt head in a conventional manner. In the unlocked position, the handle orifice is disposed about the indented portion of the connecting pin and the ratchet head can rotate in a full circle about the connecting pin axis. This allows the ratchet wrench to be used to rapidly rotate a nut by moving the handle in a reciprocating manner.

When a nut or bolt head to be rotated by the ratchet wrench is near an obstruction, the handle can be unlocked, rotated about the connecting pin axis, then locked, thereby adjusting the angle between the longitudinal axis of the handle and the longitudinal axis of the ratchet head. In many instances, such angular adjustment allows the ratchet wrench to be used to rotate the nut or bolthead the conventional manner while avoiding contact between the handle and the obstruction.

In other embodiments of the invention, the improved dual action ratchet device of the present invention is employed in breaker bars and combination wrenches. In these applications, as in the socket wrench embodiment discussed above, the ratchet device is designed to be used in a first locked, variably angled configuration to transmit force applied to a moment arm to directly tighten or loosen threaded means and in a second unlocked configuration to reciprocate the moment arm and thereby rapidly rotate the threaded means.

BRIEF DESCRIPTION OF THE DRAWINGS

The features of the present invention, together with further objects and advantages thereof. may best be understood by reference to the following description taken in connection with the accompanying drawings on which.

DESCRIPTION OF THE PREFERRED EMBODIMENT

Figure 1:
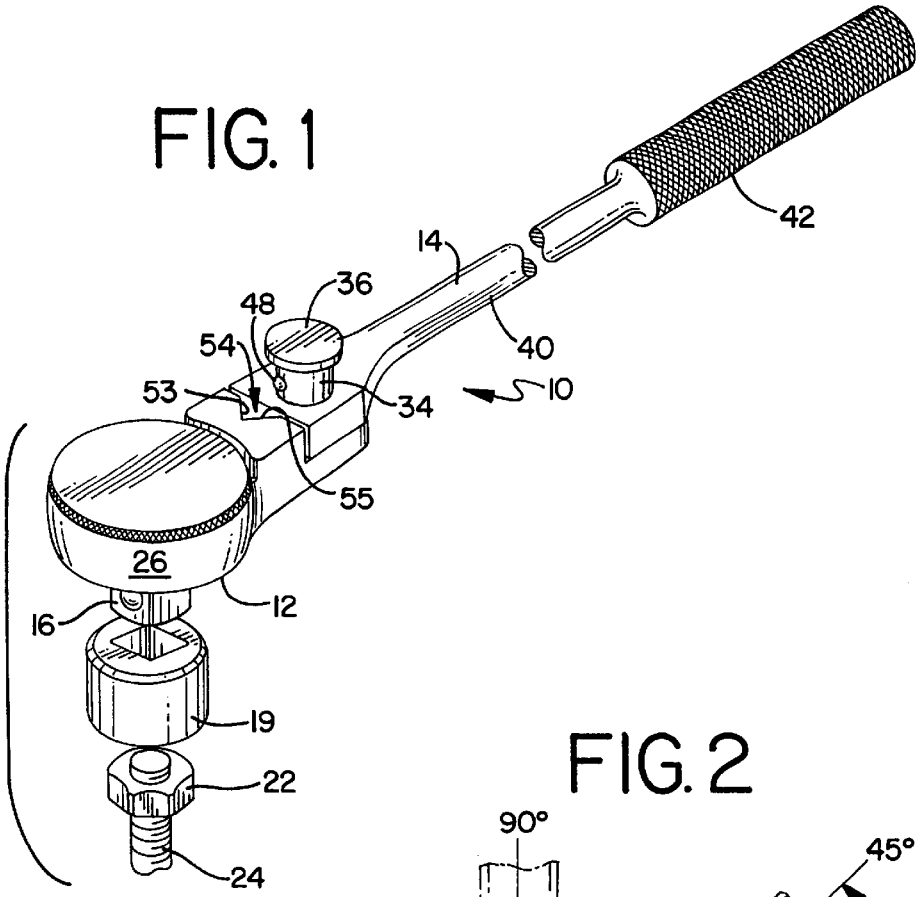
FIG. 1 is a perspective view of the dual action wrench in accordance with the present invention, in such tile wrench handle is in a first and locked position with respect to the wrench body having a conventional ratchet mechanism and a shank to drive a socket head.

In the preferred embodiment of the invention, as illustrated in FIGS. 1–6, a wrench 10 is shown including a wrench body 12, a wrench handle 14, and a shank 16 extending downwardly from the center of wrench body 12. The wrench is provided with a conventional ratchet mechanism (not shown), including a direction selector 18 which can be moved between positions "on" and "off" to cause the shank 16 to spin or drive a socket head 19 either in a clockwise direction ("on") or in a counterclockwise direction ("off"). Thus, as shown in FIG. 1, clockwise movement of socket head 19 will cause socket 19 and hence nut 22 to advance on conventionally threaded bolt 24 while counterclockwise movement will cause the nut to retreat. Wrench body 12 includes a case 26 containing the conventional ratchet mechanism (not shown). A neck 28 extends outwardly from the case at a lower portion thereof. Neck 28 is undercut to provide a shoulder 30 and a flat land 32, with shoulder 30 extending from the land to the top surface 31 of the wrench body. Land 32 and surface 31 are generally parallel to each other. Shoulder 30 is provided with a centrally disposed v-shaped notch 54 which extends between top surface 31 and land 32.

A pivot pin 34 is press-fit in wrench body 12 so that it extends upwardly from a central portion of land 32. An enlarged handle retaining head 36 extends radially outwardly from the upper end of pivot pin 34.

Wrench handle 14 includes a proximal enlarged rectangular end portion 38, an intermediate shaft portion 40, and a distal grip portion 42. Rectangular portion 38 is provided with a cylindrical opening 44 having a diameter only slightly larger than the diameter of pivot pin 34 to enable the handle to fit snugly so that it can be freely rotated on pivot pin without significant wobble. Pivot pin 34 includes a spring-loaded detent ball 48 (spring not shown) which engages a circumferential chamfer 50 when the handle is locked in position (FIG. 1) and which rides along a chamfer 52 when the handle is unlocked or freed for cranking motion, as the position shown in FIG. 4 in phantom lines.

Returning to shoulder 30, it is seen that notch 54 forms a 90° angle through the intersection of walls 53 and 55 cut into shoulder 30. Depending upon the position of handle 14, it should be understood that either of the corners 14*a* or 14*b* can complementarily mate within notch 54.

Figure 2:
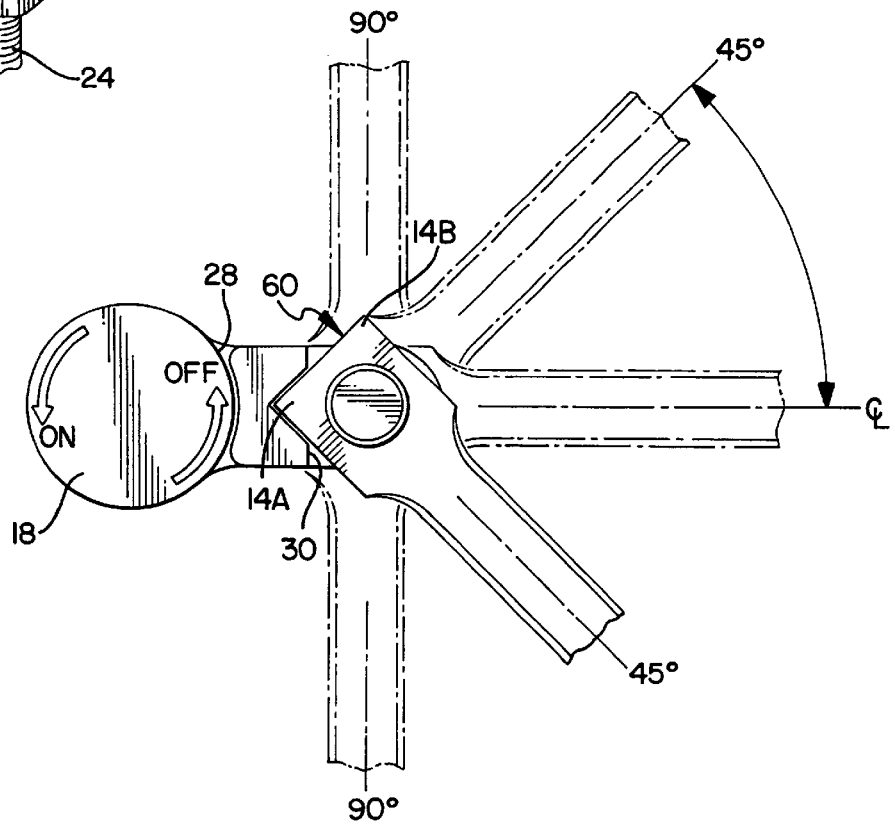
FIG. 2 is a fragmentary top view of the wrench of FIG. 1 with the wrench handle locked in an angled position with respect to the wrench body in solid lines, and in phantom lines, the other four positions clear of the wrench body to permit the body and handle to pivot in a semi-circle, in 45° increments about a pivot pin mounted in the wrench body.

In the illustrated embodiment of FIG. 2, the v-shaped notch 54 being cut at a 90° angle, only allows handle 14 to be positioned with centers at 45 degree intervals. Of course, this necessarily means that handle 14 is only allowed to move along a 180° sweep with respect to wrench body 12. From the perspective of protecting the integrity of corners 14A, 14B and walls 53, 55, from spaulling, chipping and general wear, the limited number of positions available due to the v-shaped notch has been found to be superior to other designs, such as those which use splines. The limitation of the number of available indexable positions has been found to have had no practical effect on performance.

Figure 3:
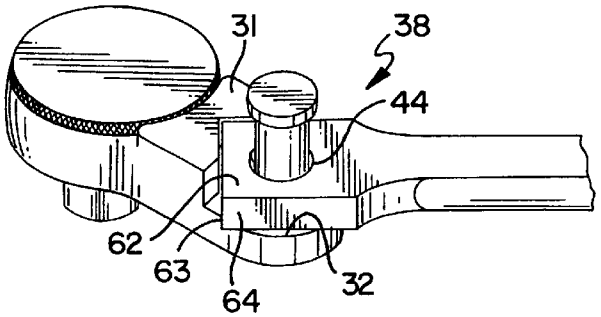
FIG. 3 is a fragmentary perspective view of the wrench of FIG. 1 showing the handle in one of its locked positions with the v-shaped notch in the wrench body.

Distal enlarged end 38 of handle 14 has a leading edge 60 having generally parallel top and bottom surfaces 62 and 64 and a planar face 63 confronting shoulder 30. Leading edge 60 is delimited by the opposed corners 14A and 14B, which are also formed as 90° corners. The face 63 is perpendicular to top and bottom surfaces 62 and 64, and is dimensioned to provide a deminimus gap between shoulder 30 and itself when in the straight locked position, as seen in FIG. 1. Likewise, there is a deminimus gap between corners 14A, 14B and walls 53 and 55 of notch 54 when handle 14 is indexed in one of the other positions as seen in FIGS. 2 and 3. Thus, even with this deminimus gap, forces applied to the wrench handle are transmuted to the wrench body at the interface of the mating faces. Again, in the illustrated embodiment of FIG. 2, the v-shaped notch insures a good mating fit.

Figure 5:
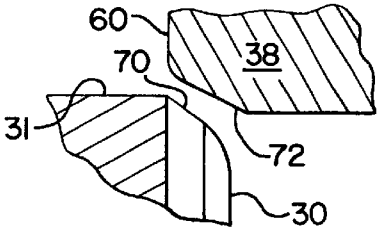
FIG. 5. is a fragmentary elevation view of a portion of the wrench of FIGS. 1–5 showing chamfers which guide the wrench handle and the wrench body into mating engagement when the wrench handle is locked into position as in FIG. 1.
Figure 6:
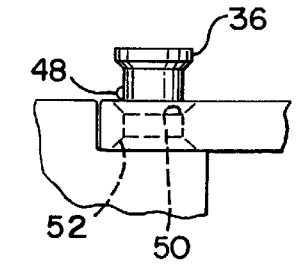
FIG. 6 is a fragmentary elevation view of a portion of the wrench of FIGS. 1–5 showing chamfers which engage the spring loaded detent ball in pivot pin of the wrench.

In a particularly preferred embodiment, as illustrated in FIG. 5, a chamfer 70 is formed along shoulder 30 where it meets top surface 31 and a corresponding chamfer 72 is formed along the leading edge 60 where it meets bottom surface 64. These chamfers facilitate operation of the wrench during indexing of the handle.

Figure 4:
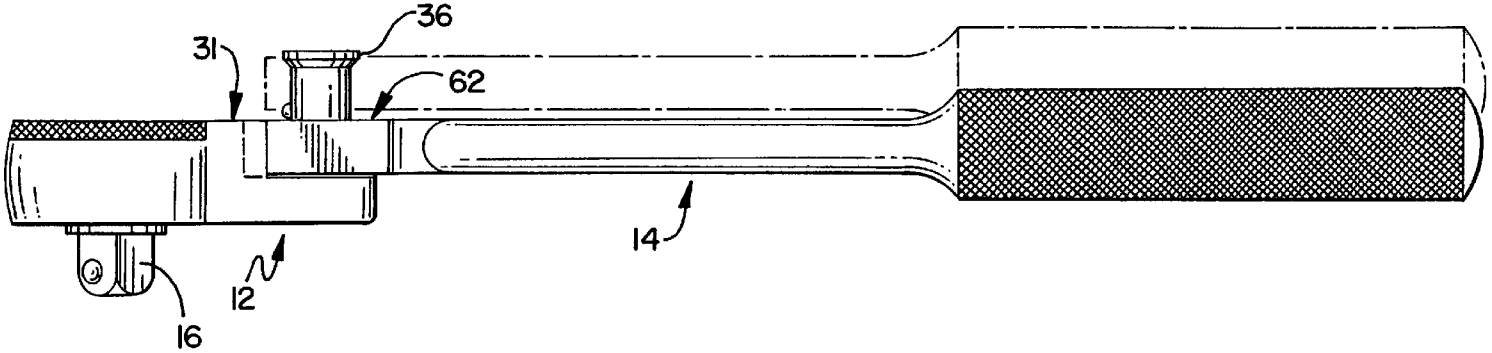
FIG. 4 is an side elevation view wherein the handle is depicted in solid line in a locked position and the handle is depicted in phantom line in an unlocked position.

In operation, wrench handle 14 is movable from a first position as seen, for example, in FIG. 4, in which the handle is locked against angular movement with respect to wrench body 12 and shank 16, to a second position in which the handle is unlocked or freed for cranking motion. In the second position, as seen in phantom lines, the handle 14 clears top surface 31 of wrench body 12, which permits the handle to be freely rotated, full circle, about pivot pin 34. This enables the wrench body to be cranked about the axis of the shank and a socket head and nut connected thereto. The handle may be rendered immovable with respect to the wrench body in only five different positions by moving the handle with respect to the wrench body to a position where the corners 14A or 14B are locked within notch 54, or where face 63 is in confronting relationship with shoulder 30, shown in FIG. 2. When in these positions, detent ball 48 engages chamfer 50, maintaining the handle in the desired position. When the handle is in this first position, the wrench can be utilized as a conventional socket or a ratchet wrench by simply adjusting the ratchet direction selector 18 as desired.

In order to move the wrench handle to the second and unlocked position, the user grips the underside of the handle adjacent to wrench body 12 and presses upon the retaining head 36 of the pivot pin with his thumb, exerting sufficient force to cause spring-loaded detent ball 48 to retract, thereby allowing the handle to move to the upper or unlocked position shown in phantom lines in FIG. 4. When top surface 62 of the enlarged end 38 of the handle comes in contact with the undersurface of retaining head 36, detent ball 48 rides along chamfer 52, as explained earlier, allowing the handle to rotate freely about pivot pin 34, but preventing it from moving inadvertently from the second position into the first position.

When in the second and unlocked position, the handle can be rotated full circle about pivot pin 34 while simultaneously causing wrench body 12 to rotate full circle about the axis of shank 16. Thus the wrench can he "cranked" to rapidly turn off or turn on a nut or bolt head. If the user encounters substantial resistance, he can again set corners 14A, 14B within groove 54 or face 63 opposite to shoulder 30, then set the handle again to the first position against the action of detent ball 38. Chamfers 70 and 72 will facilitate the alignment and movement of the handle and head with respect to each other making this transition between the first and second positions possible even while the wrench socket is engaged.

Figure 7:
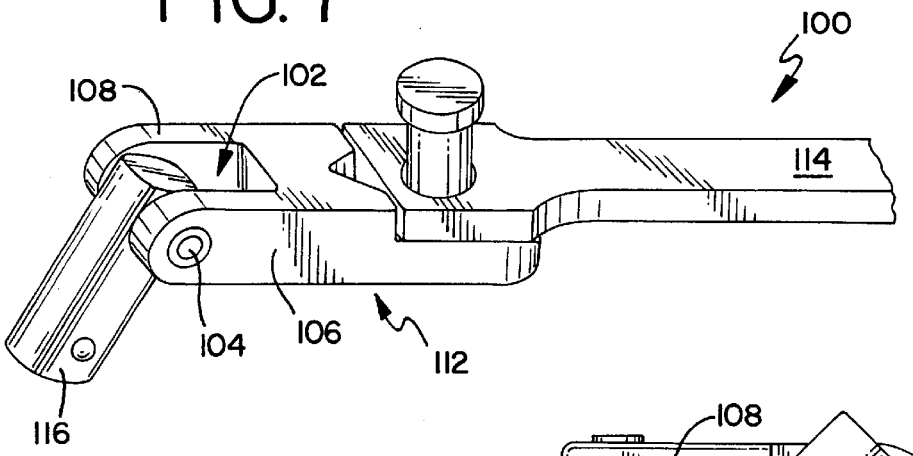
FIG. 7 is a partial perspective view of a second embodiment of a wrench in accordance with the present invention in which the wrench handle is locked in position with respect to a wrench body having a conventional breaker bar mechanism.
Figure 8:
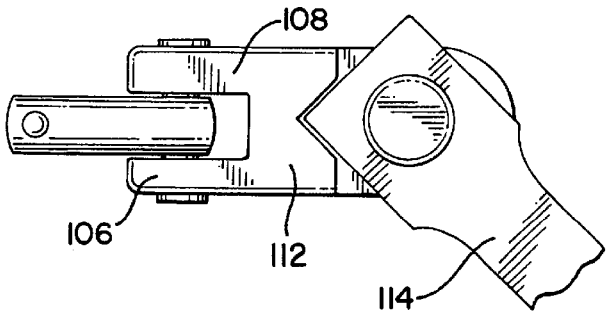
FIG. 8 is a partial top view of the wrench of FIG. 7.

In a second embodiment of the invention, as illustrated in FIGS. 7 and 8, a wrench in the form of breaker bar 100, in accordance with the present invention, is illustrated. Breaker bar 100 includes a wrench body 112 and a shank pin 116 which operates generally like the wrench of the previously described embodiment. Shank 116 is pivotally mounted in a cavity 102 in the distal end of body 112 by way of pin 104 which passes through the shank and is mounted to arms 106 and 108 on either side of cavity 102. In this way, as is well-reorganized in the art, the shank may pivot about pin 104 in order to orient the breaker bar handle 14 with respect to the shank, as desired.

The handle of the breaker bar 114 (shown cut away) and corresponding portions of wrench body 112 include a locking/reciprocating mechanism as previously described. Thus, breaker bar 100 may be used in either a first position in which the handle is locked against angular movement with respect to the wrench body (as illustrated in FIGS. 7 and 8) or in a second position which the handle is unlocked or freed for reciprocating motion.

Figure 9:
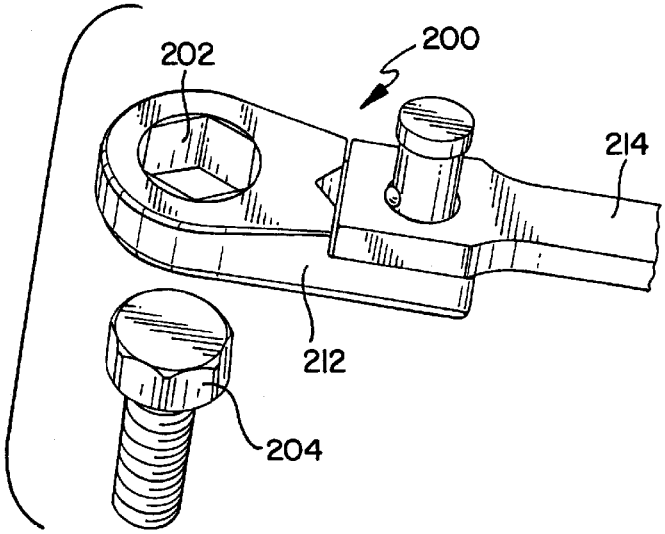
FIG. 9 is a partial perspective view of a third embodiment of a wrench in accordance with the present invention, in which the wrench handle is locked in position with respect to a wrench body having a conventional 6 point hex boxed end.
Figure 10:
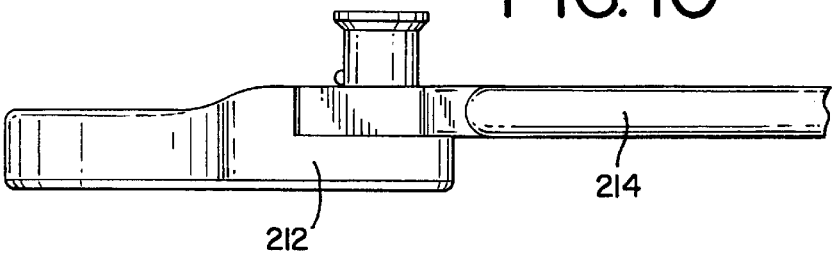
FIG. 10 is a side elevation view of the wrench of FIG. 9.

In a third embodiment of the invention, as illustrated in FIGS. 9 and 10, a box wrench 200 in accordance with the present invention is illustrated. Open end wrenches could, of course, be used in lieu of box end wrenches. The box end wrench includes a wrench body 212 having a six point hex opening 202 which is dimensioned to mate with a correspondingly-sized head of a bolt 204, so that the bolt can be either screwed down or loosened, as desired. The wrench body is attached to a handle 214. Wrench body 212 and handle 214 are attached using the locking/reciprocating mechanism in accordance with the present invention.

While the present invention is described above in connection with a preferred or illustrated embodiment, this embodiment is not intended to be exclusive or limiting of the invention. Rather, the invention is intended to cover all alternative, modifications and equivalents which may be included within the spirit and scope of the invention as defined by the appended claims.

What is claimed is:

1. A wrench comprising:

a wrench body;

a handle having a first end for gripping by a user and a second end for transmitting force from the handle to the wrench body;

a pivot pin fixed to the wrench body and extending through a circular opening in the second end of the handle to permit sliding movement of the handle along the pivot pin between a locked position and an unlocked position; and the wrench body having a shoulder with a v-shaped notch cut into said shoulder and the second end of the handle having a planar leading edge which is delimited by a pair of opposed corners, said v-shaped notch positioned and dimensioned to receive either of the corners whereby in the locked position of the wrench, one of the corners of the handle mates within the v-shaped notch in a fixed force transmitting relationship or the planar leading edge of the handle opposes said shoulder in a fixed force transmitting relationship.

2. The wrench of claim 1 in which the wrench is provided with a shank extending generally parallel to and away from the pivot pin.

3. The wrench of claim 1 in which the wrench body is provided with a breaker bar.

4. The wrench of claim 1 in which the wrench body is provided with one of a box end and open end wrench.

5. The wrench of claim 1 in which the pivot pin includes a spring-loaded detent ball and the circular opening includes a circumferential chamfer whereby when the handle is locked in position, the detent ball rides along the chamfer.

6. The wrench of claim 1 in which the wrench body and handle are indexably positioned with respect to each other at 45° intervals.

7. The wrench of claim 1 in which the handle is indexable relative to the wrench a total of 180°.

8. The wrench of claim 1 in which a chamfer is formed along the shoulder of the wrench body and a corresponding chamfer is formed along the leading edge of the handle.

9. A wrench comprising:

a wrench body having a pivot pin extending therefrom and a shoulder surface having a generally v-shaped notch; and a handle including an end portion having a front planar face and two side faces that converge with the first planar face to form two corner edges, the end portion further including an opening to slidably accommodate the pivot pin of the wrench body;

wherein the handle is positionable with respect to the wrench body between a first position wherein one of the two corner edges of the handle is disposed within the v-shaped notch of the wrench body and a second position wherein one of the faces of the end portion of the handle bears against the shoulder surface of the wrench body.

10. The wrench of claim 9 wherein the wrench body includes a ratchet mechanism.

11. The wrench of claim 9 wherein the handle is positionable with respect to the wrench body at about 45 degree increments.

12. A wrench comprising:

a wrench body including a planar land having a pivot pin extending therefrom, the pivot pin including an enlarged distal end, the wrench body further including a shoulder surface disposed generally perpendicular to the land and having a generally v-shaped notch therein; and a handle including an end portion having a front planar face and two side faces that converge with the first planar face to form two corner edges, the end portion further including an opening having the pivot pin of the wrench body disposed therein to permit sliding movement of the handle between one of five locked positions wherein the end portion is immediately adjacent the land and an unlocked position wherein the end portion is immediately adjacent the enlarged distal end of the pivot pin; and wherein the handle is adjustable with respect to the wrench body in the unlocked position, at least one of the locked positions defined by one of the two corner edges of the handle being disposed within the v-shaped notch of the wrench body and at least one other of the locked positions being defined by one of the faces of the end portion of the handle being abutted against the shoulder surface of the wrench body.

* * * * *